US009656842B2

(12) United States Patent
Sullivan

(10) Patent No.: US 9,656,842 B2
(45) Date of Patent: May 23, 2017

(54) METHOD AND APPARATUS FOR FIRE FIGHTING EFFICIENCY AND SAFETY

(71) Applicant: Christopher Sullivan, St. John, IN (US)

(72) Inventor: Christopher Sullivan, St. John, IN (US)

( * ) Notice: Subject to any disclaimer, the term of this patent is extended or adjusted under 35 U.S.C. 154(b) by 0 days.

(21) Appl. No.: 14/882,235

(22) Filed: Oct. 13, 2015

(65) Prior Publication Data

US 2016/0136470 A1 May 19, 2016

Related U.S. Application Data

(63) Continuation-in-part of application No. 13/371,400, filed on Feb. 11, 2012, now abandoned.

(51) Int. Cl.

| | |
|---|---|
| ***B66F 11/04*** | (2006.01) |
| ***A62C 31/28*** | (2006.01) |
| ***A62C 27/00*** | (2006.01) |
| *A62C 31/22* | (2006.01) |

(52) U.S. Cl.

CPC ..... *B66F 11/044* (2013.01); *A62C 27/00* (2013.01); *A62C 31/28* (2013.01); *A62C 31/22* (2013.01)

(58) Field of Classification Search

CPC ..... A62C 27/00; A62C 31/24; A62C 31/28; A62C 31/22; B66F 11/044; B66F 11/046; B66F 11/048

USPC ..... 169/51, 52, 24, 25, 46

See application file for complete search history.

(56) References Cited

U.S. PATENT DOCUMENTS

| | | | | |
|---|---|---|---|---|
| 3,212,604 A | | 10/1965 | Garnett | 182/51 |
| 3,253,677 A | * | 5/1966 | Krynytzky | B66F 11/044 169/24 |
| 3,565,372 A | * | 2/1971 | Jones | B27B 17/0091 248/278.1 |
| 5,159,989 A | | 11/1992 | Claxton | 180/41 |
| 5,211,245 A | | 5/1993 | Relyea et al. | 169/24 |
| 5,746,396 A | | 5/1998 | Thorton-Trump | 244/134 R |
| 5,836,398 A | * | 11/1998 | White | A62C 27/00 169/24 |
| 7,007,761 B1 | | 3/2006 | Johnson, IV | 169/24 |
| 7,055,613 B1 | | 6/2006 | Bissen et al. | 169/24 |
| 2003/0173151 A1 | | 9/2003 | Bodtke et al. | 182/18 |

(Continued)

OTHER PUBLICATIONS

Snag-hit skylinft & fire engines stay idle as building burns—The Telegraph Dec. 26, 2011, Reference supplied in parent case.

(Continued)

*Primary Examiner* — Christopher Kim

(74) *Attorney, Agent, or Firm* — Clifford H. Kraft

(57) ABSTRACT

A small lift vehicle with an articulating boom can maneuver into very small spaces in front of, alongside or behind burning buildings, especially residences. The lift vehicle can quickly deploy with deployable outriggers capable of multi-directional status for support. The boom can support a basket that can have a water cannon. The boom can be controlled by a fireman in the boom itself, and can move into the right position to put water on the seat of a fire. The boom can be equipped with a waterproof camera and/or a thermal imaging system, a hydraulic chainsaw, a gas monitor, a piercing nozzle, a stick chainsaw, and a protective heat curtain. The preferred base has 4-wheel drive and steering for maneuvering on any type of terrain including snow.

17 Claims, 4 Drawing Sheets

(56) References Cited

U.S. PATENT DOCUMENTS

| | | | | |
|---|---|---|---|---|
| 2004/0173404 | A1 | 9/2004 | Kobel | 182/2.1 |
| 2009/0220325 | A1* | 9/2009 | Berney | B60P 1/6454 414/494 |
| 2013/0087411 | A1 | 4/2013 | Shade | 182/63.1 |

OTHER PUBLICATIONS

Genie Boom Lifts: A Firefighters' Life Saver—Kimberly Fisher—Nov. 20, 2011, Reference supplied in parent case.

Robotic Firefighters big and small impress—jconline.com, Lafayette, IN—retrieved Feb. 22, 2012 (Not Admitted to Be Prior Art), Reference supplied in parent case.

* cited by examiner

METHOD AND APPARATUS FOR FIRE FIGHTING EFFICIENCY AND SAFETY

This is a continuation-in-part of application Ser. No. 13/371,400 filed Feb. 11, 2012. Application Ser. No. 13/371,400 is hereby incorporated by reference in its entirety.

BACKGROUND

Field of the Invention

The present invention relates generally to the field of fire fighting and more particularly to a method and apparatus that vastly increases fire fighters' efficiency and safety.

Description of the Problem

Each year building fires cause millions of dollars in damage and take the lives of countless fire fighters. Fire companies typically deploy a variety of equipment to a fire. One piece of equipment the most fire departments have is a ladder truck. Ladder trucks usually have an extendable ladder that can rotate at its base. Water can be pumped to a water cannon or nozzle at the top. These trucks typically cost near a million dollars.

However, in service, especially with residential fires, the ladders only get used around one in fifteen fires. The reason is that the truck is usually too large to maneuver near enough to the fire to use the extendable ladder. Also, many residential streets have numerous overhead obstacles such as power lines, street lights, trees and the like. While the extendable ladder is a good idea in theory, in practice it is a failure since most of the time it cannot be used.

It would be advantageous to have a piece of fire fighting equipment that could use the principle of an extendable or maneuverable arm that could get in close enough to be used in most fires.

It is common knowledge that the longer a fire is allowed to burn, the more damage it will do, the harder it will be to put out, and the more danger it will present to fire fighters and others. On the other hand, if fire fighters can put water on the seat of a fire, wherever located, very quickly after their arrival at the scene, what could have been a large, dangerous fire, can many times be quickly extinguished with minimum damage and danger to the fire fighters. It would be advantageous to have a system and method where fire fighters can immediately put water directly on the seat of a fire.

Many times it is necessary for fire fighters to cut holes in a roof to vent a fire and to get water on it. This usually requires that fire fighters must climb up onto the roof. This can be very dangerous for a number of reasons. First, the structural integrity of the roof may be compromised with a danger of a fall-through or a total collapse. Second, in the winter, in northern climates, a roof that is still structurally sound can have ice on it making it very slippery, and if the pitch is sufficient, impossible to climb on. Even in summer or in warm climates, roofs can have accumulated moss, water, branches and other dangerous material. It would be advantageous if there were a system and method that would allow fire fighters to penetrate a roof without having to actually stand on it.

SUMMARY OF THE INVENTION

The present invention relates to a method and apparatus that provides a small lift vehicle with an articulating boom that can maneuver into very small spaces in front of, alongside or behind burning buildings, especially residences. The entire vehicle with trailer costs less than on fourth what a ladder fire truck costs. The lift vehicle can quickly deploy with quick deployable outriggers capable of multi-directional status for support. The boom can support a basket that can have a water cannon or other water or foam deployment apparatus. The boom can be controlled by a fireman in the boom itself, and can move into exactly the right position to very quickly put water on the seat of a fire. The boom can also be equipped with a waterproof camera and/or a thermal imaging system to allow maneuvering the boom into a position remotely. The thermal imaging system can detect hot areas on a roof indicating where the fire is. The boom can be equipped with a hydraulic chainsaw that can be used to cut an access hole in a roof to gain better accessibility to the fire. In addition, the boom can have a gas monitor, a piercing nozzle, a stick chainsaw, and a protective heat curtain. The preferred base has 4-wheel drive and steering for maneuvering on any type of terrain including snow.

DESCRIPTION OF THE FIGURES

Attention is now directed to several drawings that illustrate features of the present invention.

Several drawings and illustrations have been presented to aid in understanding the present invention. The scope of the present invention is not limited to what is shown in the figures.

DESCRIPTION OF THE PREFERRED EMBODIMENT

The present invention relates to a small lift vehicle with an articulating boom that can maneuver into very small spaces in front of, alongside or behind burning buildings.

Figure 1:
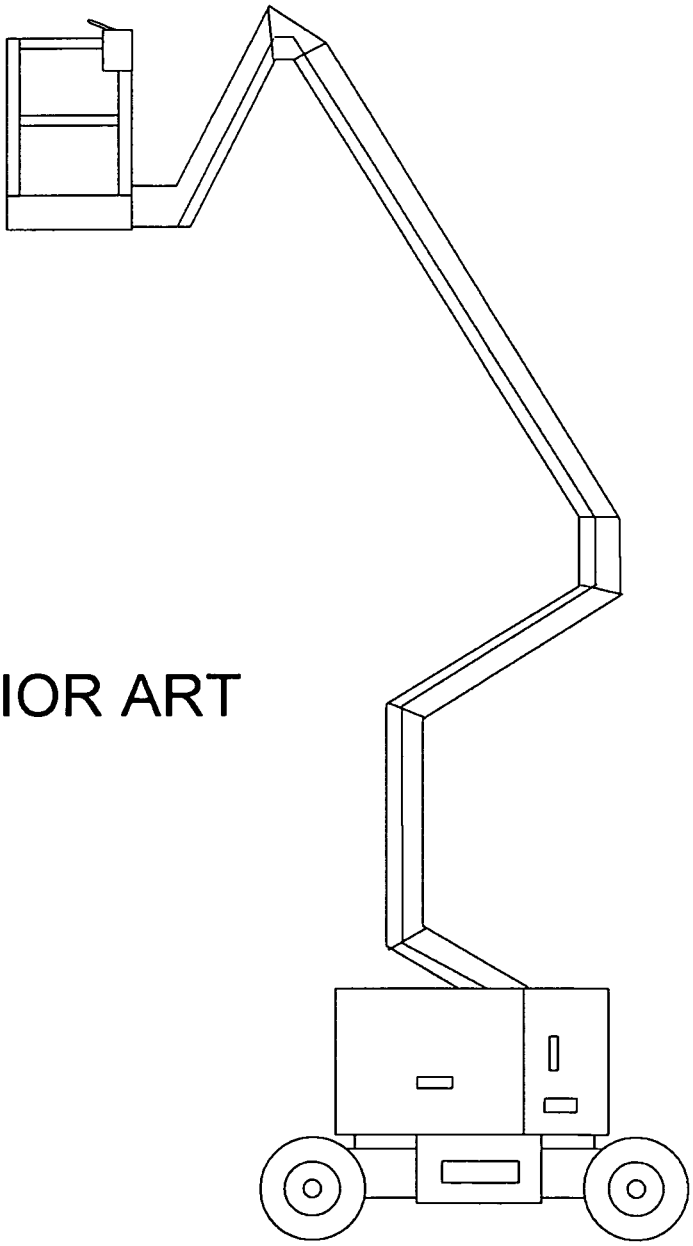
FIG. 1 shows a prior art commercial lift.

A family of basic prior art construction units are known as GENIE™ lifts. An example is shown in FIG. 1. GENIE is a registered trademark of Terex Corporation. Other companies also make prior art lifts that include a base unit that can be driven or maneuvered and an articulating boom with a basket.

Figure 2:
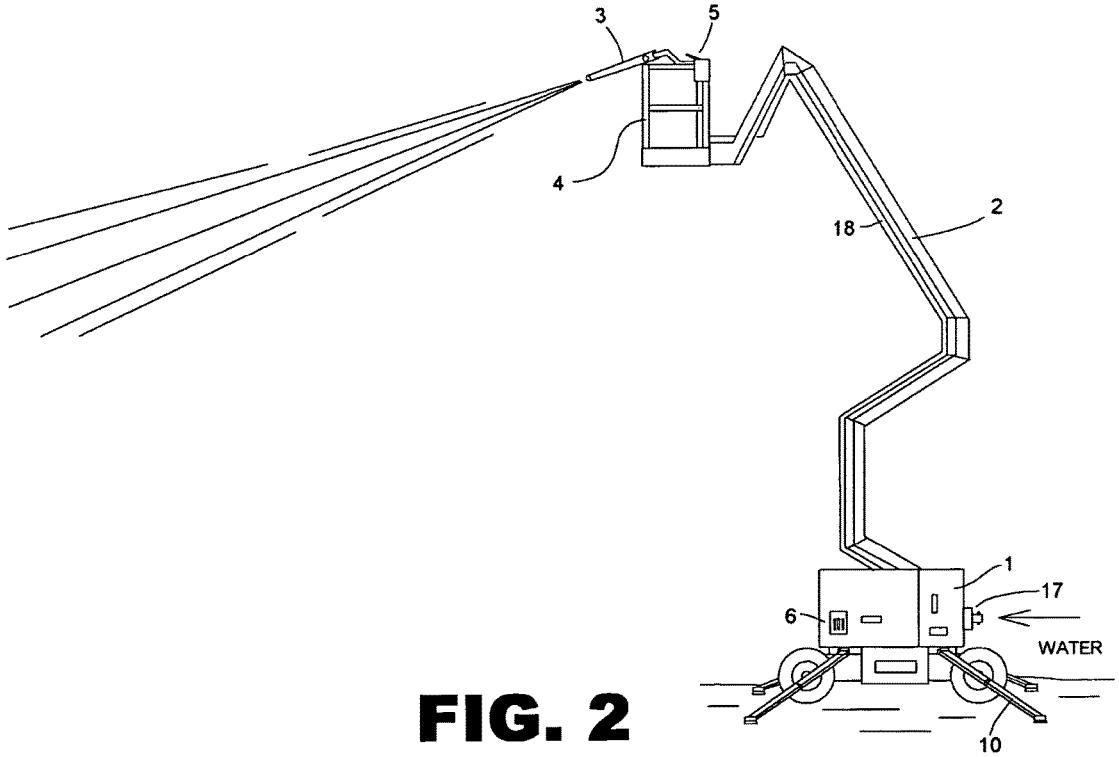
FIG. 2 shows an embodiment of the lift of the present invention with water.

The present invention adapts the basic design of a construction lift vehicle to fire fighting. Turning to FIG. 2, an easily maneuvered vehicle 1 (preferably with 4-wheel drive) is equipped with an articulating boom 2 that has a water cannon 3 on a basket 4. The water cannon 3 is fed by pipe 18 from a water entry port 17 on the vehicle 1 or on the boom 2. The pipe 18 is designed with joints that match the folding and articulation of the boom 2. The basket 4 has controls 5 for the boom, and preferably, there is a set of remote controls 6 that can be operated from the ground. A set of quick-deployable outriggers 10 can be attached to four corners of the vehicle 1. These can be swept multi-directionally to allow correct positioning for support for the weight of the arm, as well as kick-back from the water cannon 3, and yet make it easy to get as close as safely possible to a structure.

The lift vehicle should be preferably a four-wheel drive, short wheel base, steerable vehicle with exactly four wheels adapted to be rapidly deployed from a trailer and rapidly maneuverable in tight spaces, said vehicle having an articulated boom with an operator basket. By short wheel base, I mean a wheel base smaller than that of a typical automobile (shorter than approximately six feet).

Figure 3:
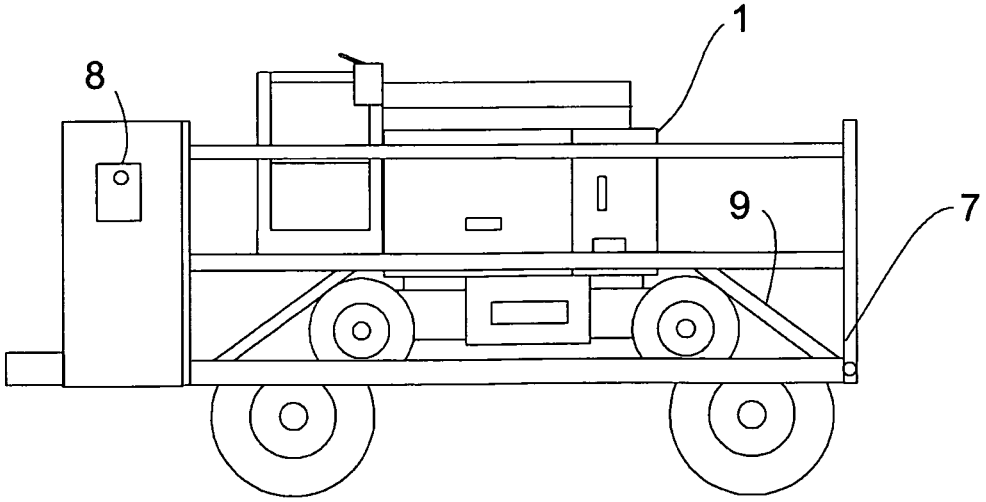
FIG. 3 shows the lift vehicle on a trailer for deployment to a fire.

The lift vehicle 1 can be driven to the fire with a pickup truck (such as a one ton truck) with a trailer. This is the preferred way to transport the device to the fire; however, any other transport method or vehicle is within the scope of the present invention. This can be seen in FIG. 3. For the purpose of quick attack, the lift vehicle 1 can be released from the trailer 7 typically by pressing one button 8 that releases a set of hydraulic arms 9 that secure the lift vehicle 1 to the trailer 7. Optionally, the trailer 7 can be outfitted with tool boxes to carry a normal array of tools such as axes, pike poles and the like, as well as, generators and light towers.

Figure 4:
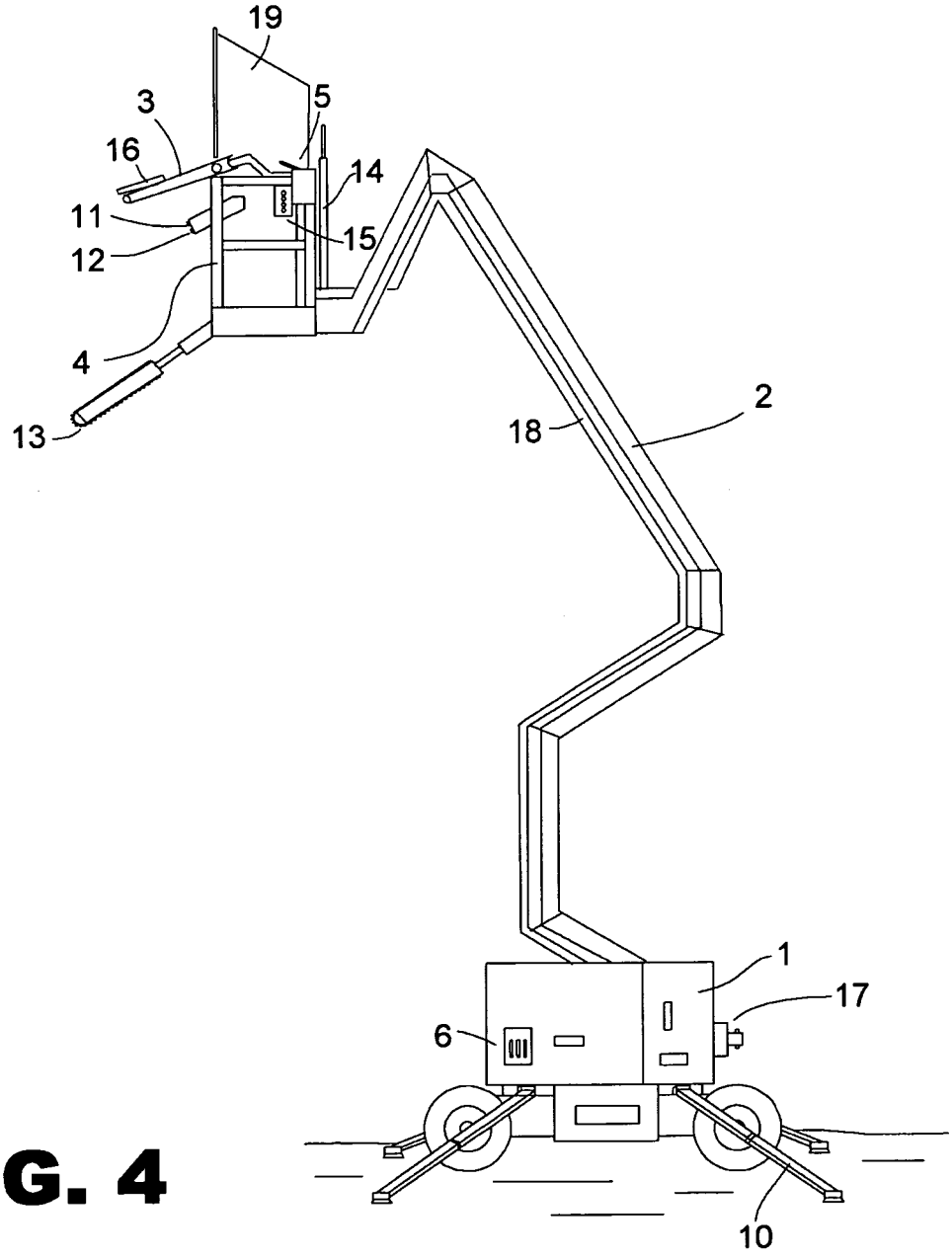
FIG. 4 shows an embodiment of the lift of the present invention with other accessories.

FIG. 4 shows the lift vehicle 1 of the present invention with several accessories. A waterproof camera 11 can be added to the basket 4 as well as a thermal imaging camera 12. An operator, either in the basket 4, or on the ground can maneuver via remote control from a safe distance, but still see the seat of the fire either from that basket 4 or from the ground. This allows the boom to approach the roof of a burning building without risking the life of a fire fighter falling through a weakened roof or off of a slippery one. A hydraulic (or other powered) chain saw 13 can be attached to the front of the basket 4 so that, from a safe distance, the operator can cut an access hole or vent hole in order to gain better accessibility to the seat of the fire and to relieve smoke and hot gases from interior of the structure to make an inside attack or rescue easier and safer for personnel. In addition to the main chainsaw 13, a chainsaw stick 14 can be carried in, or attached to, the basket 4. This can be used to clear tree branches and the like if necessary. A four-gas monitor 15 can provide extra safety for the operator, and a piercing nozzle 16 can help make holes. In addition to the above-named equipment, the basket can be equipped with a heat curtain 19 to protect from too-hot conditions.

As previously stated, the lift vehicle 1 of the present invention can have 4-wheel drive (although a vehicle with 2-wheel drive is within the scope of the present invention) and steering. The makes access to a fire scene much easier (or possible) compared to a normal fire truck. The fire truck is generally too big and heavy to bring into a yard (for example, on a lawn or a muddy area), and it would have to dodge power lines, trees, street lamps and many other obstacles. The device of the present invention can get around and under these obstacles and up close to a structure. In neighborhoods with narrow, or one-way, streets, regular truck work is typically tight, slow or even impossible. With the present invention, the lift vehicle 1 can get to the structure even if it has to be off-loaded down the block. The present invention is also very useful in shopping malls. These malls are laid out with anchor stores at the end which branch back to a common center kiosk or food court. Ladder trucks again are useless. The lift vehicle 1 of the present invention can pass through a loading dock or double door quickly reaching a fire in the center of the mall. The alternative is for firemen to carry large ladders into the building which is much slower and more cumbersome.

Several descriptions and illustrations have been presented to aid in understanding the present invention. One with skill in the art will understand that numerous changes and variations are possible without departing from the spirit of the invention. Each of these changes and variations is within the scope of the present invention.

I claim:

1. A fire fighting apparatus comprising:

a four-wheel drive, short wheel base, steerable vehicle with exactly four wheels that is carried to a fire location on a trailer adapted to be deployed from the trailer and rapidly maneuverable in restricted spaces, said vehicle having an articulated boom with an operator basket;

a fire fighting liquid deployment device attached to said boom or basket;

piping for said liquid deployment device cooperating with said boom to supply fire fighting liquid to said device;

a water-resistant or water-proof camera attached to said boom or basket;

a first set of controls for said boom in said basket;

a second set of controls for said boom on said vehicle;

a plurality of extendable sweeping legs attached to said vehicle deployable to stabilize said vehicle with said boom extended.

2. The fire fighting apparatus of claim 1 further comprising a thermal imaging device attached to said boom or basket.

3. The fire fighting apparatus of claim 1 further comprising an extendable chain saw attached to said boom or basket.

4. The fire fighting apparatus of claim 1 further comprising a piercing nozzle deployable from said basket.

5. The fire fighting apparatus of claim 1 wherein said fire fighting liquid is water.

6. The fire fighting apparatus of claim 1 wherein said fire fighting liquid deployment device is a water cannon.

7. The fire fighting apparatus of claim 1 wherein the trailer is adapted to carry said vehicle to a fire scene, said trailer having a set of releasable hydraulic arms for securing said vehicle for transport.

8. The fire fighting apparatus of claim 1 further comprising a gas monitor attached to said basket.

9. The fire fighting apparatus of claim 1 further comprising a heat curtain attached to said basket.

10. A method of rapid deployment of water to a fire comprising:

providing a four-wheel drive, short wheel base, steerable vehicle with exactly four wheels carried on and deployed from a trailer and maneuverable in restricted spaces, said vehicle having an articulated boom with an operator basket;

attaching a water cannon to said boom or basket;

attaching piping for said water cannon to said boom to supply fire fighting liquid to said cannon;

attaching a water-resistant or water-proof camera to said boom or basket;

providing a first set of controls for said boom in said basket;

providing a second set of controls for said boom on said vehicle;

providing a plurality of extendable sweeping legs attached to said vehicle deployable to stabilize said vehicle with said boom extended;

attaching a thermal imaging device to said boom or basket;

attaching an extendable chain saw to said boom or basket.

11. The method of claim 10 further comprising supplying a piercing nozzle deployable from said basket.

12. The method of claim 10 wherein the trailer is adapted to carry said vehicle to a fire scene, said trailer having a set of releasable hydraulic arms for securing said vehicle for transport.

13. The method of claim 10 wherein said vehicle includes 4-wheel drive.

14. The method of claim 10 further comprising providing a gas monitor attached to said basket.

15. The method of claim 10 further comprising providing a heat curtain attached to said basket.

16. A fire fighting apparatus comprising:

a four-wheel drive, short wheel base, steerable vehicle with exactly four wheels that is carried to a fire location on a trailer adapted to be deployed from the trailer and maneuverable in restricted spaces, said vehicle having an articulated boom with an operator basket;

a fire fighting liquid deployment device attached to said boom or basket;

piping for said liquid deployment device cooperating with said boom to supply fire fighting liquid to said device;

a water-resistant or water-proof camera attached to said boom or basket;

a first set of controls for said boom in said basket;

a second set of controls for said boom on said vehicle;

a plurality of extendable sweeping legs attached to said vehicle deployable to stabilize said vehicle with said boom extended;

a thermal imaging device attached to said boom or basket;

an extendable chain saw attached to said boom or basket.

17. The fire fighting apparatus of claim 16 wherein the trailer is adapted to carry said vehicle to a fire scene, said trailer having a set of releasable hydraulic arms for securing said vehicle for transport.

* * * * *